US007022061B2

(12) United States Patent
Leung et al.

(10) Patent No.: US 7,022,061 B2
(45) Date of Patent: Apr. 4, 2006

(54) CENTRIFUGE DISCHARGE PORT WITH POWER RECOVERY

(75) Inventors: Woon-Fong (Wallace) Leung, Sherbon, MA (US); Ascher H. Shapiro, Boston, MA (US)

(73) Assignee: Andritz AG, (AT)

( * ) Notice: Subject to any disclaimer, the term of this patent is extended or adjusted under 35 U.S.C. 154(b) by 244 days.

(21) Appl. No.: 10/356,853

(22) Filed: Feb. 3, 2003

(65) Prior Publication Data

US 2004/0072667 A1 Apr. 15, 2004

Related U.S. Application Data

(60) Provisional application No. 60/418,501, filed on Oct. 15, 2002.

(51) Int. Cl.
*B04B 11/00* (2006.01)
*B04B 1/20* (2006.01)

(52) U.S. Cl. ..... 494/56

(58) Field of Classification Search ..... 494/53–54, 494/56, 84; 210/380.1, 380.3
See application file for complete search history.

(56) References Cited

U.S. PATENT DOCUMENTS 1,882,389 A * 10/1932 Macisaac
2,747,793 A * 5/1956 Caddell
3,430,853 A * 3/1969 Kirk et al.
4,334,647 A * 6/1982 Taylor
4,508,530 A * 4/1985 Schlegel et al.
5,147,277 A 9/1992 Shapiro et al.
2001/0011056 A1 * 8/2001 Pieralisi
2004/0072667 A1 * 4/2004 Leung et al.
2004/0072668 A1 * 4/2004 Leung
2005/0164861 A1 * 7/2005 Bruning et al. ..... 494/56

FOREIGN PATENT DOCUMENTS

DE 3112585 A1 * 10/1982
JP 11-179236 * 7/1999
JP 11-197547 * 7/1999
JP 11-197548 * 7/1999
JP 11-290722 * 10/1999
WO 2004/035220 * 4/2005
WO 2004/035221 A1 * 4/2005

* cited by examiner

*Primary Examiner*—Charles E. Cooley
(74) *Attorney, Agent, or Firm*—R. Neil Sudol; Henry D. Coleman; William J. Sapone

(57) ABSTRACT

A rotating machine has a rotatable bowl generating a cylindrical slurry pool and at least one liquid phase discharge port assembly provided on the bowl. Each of one or more liquid phase discharge port assemblies on a bowl head define a liquid phase discharge path having a circumferential component oriented in opposition to a direction of rotation of the bowl. Each discharge port assembly includes a tubular member having at least one or two elbow pipe sections.

15 Claims, 7 Drawing Sheets

PRIOR ART
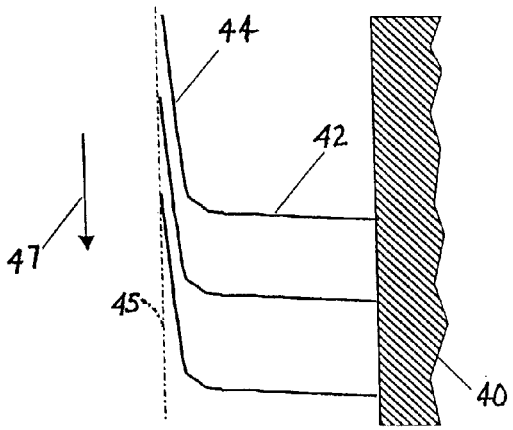
FIG. 3B
PRIOR ART
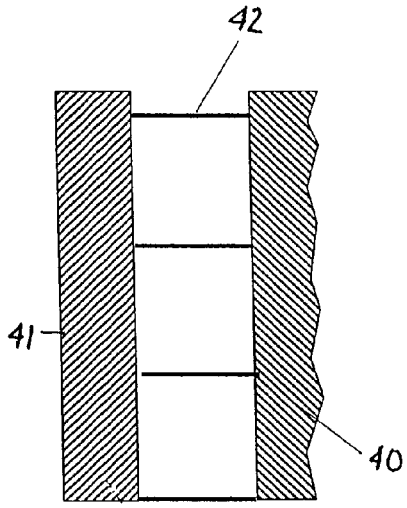
FIG. 3C
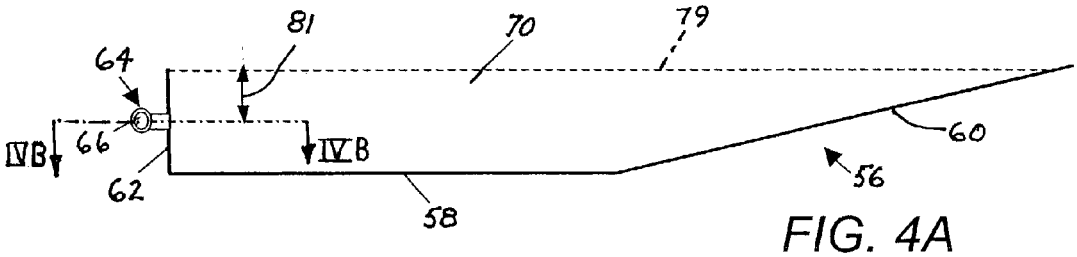
FIG. 4A
FIG. 4B
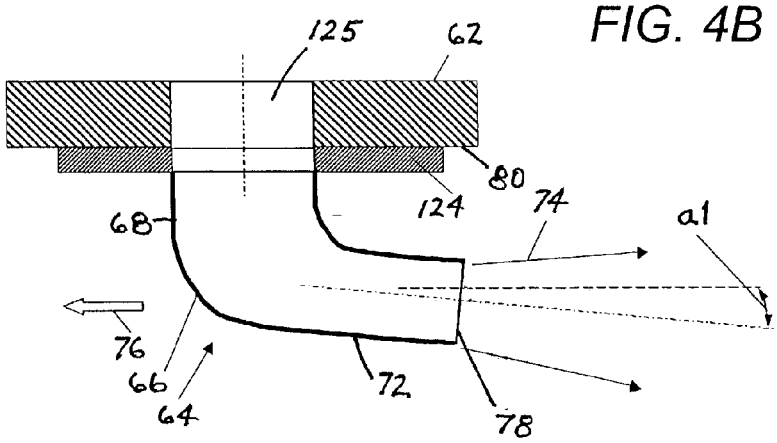

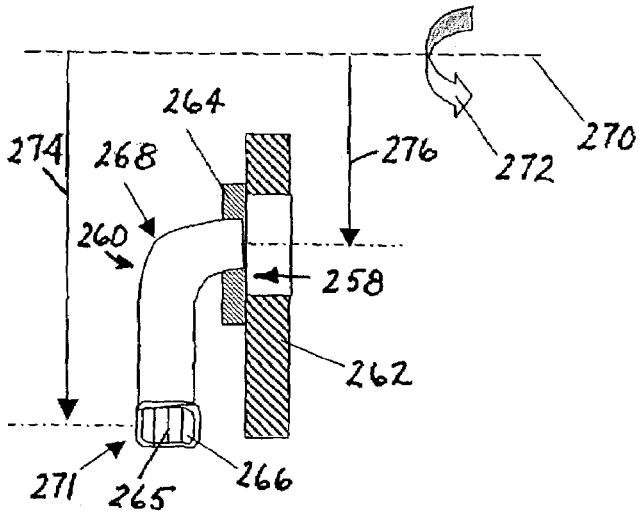
FIG. 13
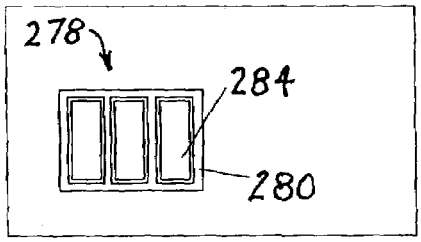
FIG. 14
FIG. 15
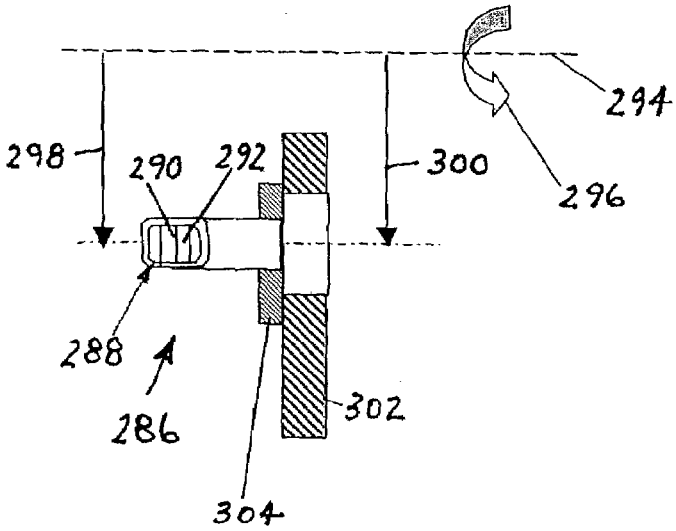

CENTRIFUGE DISCHARGE PORT WITH POWER RECOVERY

BACKGROUND OF THE INVENTION

This invention relates to a rotating machine such as a centrifuge. More particularly, this invention relates to a liquid phase discharge port for a rotating machine such as a centrifuge. This invention also relates to an associated method of effluent discharge from a rotating machine.

In bowl of a decanter centrifuge, solid-liquid separation takes place in a rotating pool that is maintained by a set of semi-circular weirs. The settled solid cake (hereafter referred as heavy phase) is conveyed toward a conical beach at one end of the rotating bowl by a screw conveyor, which rotates at a differential speed compared with the bowl, while the clarified liquid containing unsettled fine solids or the light phase (hereafter simply referred as liquid or liquid phase) overflows the weirs at the large end of the machine opposite the conical beach.

It is well known that a portion of the total hydraulic power consumed during operation of a centrifuge is wasted as kinetic energy of the discharged effluent liquid and the remaining portion wasted in dissipation. The total hydraulic power consumed is proportional to the density of the clarified liquid, the volumetric flow rate of the liquid, the rotational speed of the bowl to the second power, and the discharge radius of the pool to the second power. To that end, it is important to operate the centrifuge with the lowest possible speed and centrifugal gravity while still achieving process separation.

Another problem in centrifuge operation is related to pool level adjustment. There may be geometric constraints at the effluent bowl head, which limit the radius of the weirs. This problem is especially acute when the pool is deep especially at the spill point of the conical beach.

The physical principle of using reaction torque from a discharged high-velocity jet is well known but has not been successfully implemented to recover power from decanter centrifuges. For example, U.S. Pat. No. 5,147,277 discusses a vane apparatus wherein the clarified effluent leaving an opening of the bowl head is channeled into a plurality of channels formed by adjacent vanes. The flow turns from an axial direction to a radially inward direction along the vanes. As the fluid reaches the smaller radius of the vane apparatus, it is redirected by the vanes to flow circumferentially in a direction opposite to the direction of rotation of the centrifuge bowl.

The discharge radius of the vane apparatus of U.S. Pat. No. 5,147,277 is small to conserve power and the discharge radius is approximately at the spillover radius of the conical beach. This design incurs high pressure or head loss in part owing to friction from the large surface area of the vanes with which the discharging fluid is in contact.

SUMMARY OF THE INVENTION

The present invention is directed in part to providing a rotating machine such as a centrifuge with a liquid phase discharge port wherein power recovery is improved.

A rotating machine comprises, in accordance with the present invention, a bowl rotatable about an axis to generate a cylindrical pool of a feed slurry, the bowl having a heavy phase discharge port. At least one liquid phase discharge port assembly is provided on the bowl to define a liquid phase discharge path extending from an outlet of the discharge port assembly and having a circumferential component oriented in opposition to a direction of rotation of the bowl. The discharge port assembly has a tubular passageway with at least one bend or turn.

The tubular member may take the form of an elbow or, alternatively, two elbow pipes connected in seriatim. In the former case, the elbow preferably has an inlet branch with a component parallel to a rotation axis of the machine and an outlet branch with a component in a generally circumferential direction opposite to the direction of bowl rotation. In the latter case, the tubular member defines exactly two bends or turns. A first bend or turn is from a first direction with a component parallel to an axis of rotation of the bowl to a second direction with a component in the radial direction. A second bend or turn is from the second direction to a third direction with a component in a generally circumferential direction opposite to the direction of bowl rotation. In the general case the tubular element can extend with multiple turns (or in a smooth continuous curve) with each segment between turns having components generally extending in axial, radial and circumferential directions and the last segment subsequent to the last turn is such it has a component in a generally circumferential direction opposite to the direction of bowl rotation. In a particular embodiment, the first elbow pipe has an inlet branch or arm extending parallel to the rotation axis of the machine and an outlet branch or arm extending perpendicularly to that axis in a radial direction. The second elbow pipe has an inlet branch or arm coaxial with the outlet branch or arm of the first elbow pipe and an outlet branch or arm substantially perpendicular to a plane containing the respective inlet branch or arm and the rotation axis of the machine. Thus, the outlet of the second elbow pipe is directed in a generally circumferential direction. In particular it is directed opposite to the direction of bowl rotation.

A rotating machine comprises, in accordance with another embodiment of the present invention, a bowl rotatable about an axis to generate a cylindrical pool of a feed slurry, the bowl having a heavy phase discharge port, and at least one liquid phase discharge port assembly on the bowl. The liquid phase discharge port assembly has an inlet disposed at a predetermined first radial distance from the axis and in fluid communication with the slurry pool. The discharge port assembly has a discharge opening and defines a liquid phase discharge path extending from the discharge opening and having a circumferential component oriented in opposition to a direction of rotation of the bowl. The discharge opening of the liquid phase discharge port assembly is disposed at a second radial distance from the machine rotation axis, the second radial distance being at least as great as the first radial distance. The liquid phase discharge port assembly includes a plurality of partitions or conduits defining a plurality of parallel discharge passageways communicating with the inlet.

A liquid phase discharge port assembly in accordance with the present invention, and particularly the elbows thereof, is preferably made of a wear resistant material.

In accordance with another feature of the present invention, the liquid phase discharge port assembly includes a nozzle at an output end of the tubular member. The nozzle is provided with a tapered inner diameter to increase the velocity of the discharging liquid phase.

It is possible to use larger-diameter elbow pipe elements in the tubular member to increase the cross sectional area, thus reducing the relative velocity of flow through the elbow and piping. This advantage must be balanced against the misting, re-acceleration and additional wind drag that would arise because large piping presents a large exterior surface area where discharged jets from preceding nozzles would interfere/hit with succeeding nozzles.

A method for operating a rotating machine comprises, in accordance with the present invention, feeding a slurry to a bowl, rotating the bowl about an axis to generate a cylindrical pool of the feed slurry, discharging a heavy phase from the bowl via a discharge port during the rotating of the bowl, and discharging a liquid phase, during the rotating of the bowl, through a fluid guide member on the bowl and along a liquid phase discharge path having exactly one bend or turn, with a circumferential component oriented in opposition to a direction of rotation of the bowl.

BRIEF DESCRIPTION OF THE DRAWINGS

FIG. 3B is a schematic partial cross-sectional view taken along line IIIB—IIIB in FIG. 3A.

FIG. 3C is a schematic partial cross-sectional view taken along line IIIC—IIIC in FIG. 3A.

FIG. 4A is a schematic longitudinal cross-sectional view of a decanter centrifuge bowl with a liquid phase discharge port assembly in accordance with the present invention.

FIG. 4B is a schematic cross-sectional view taken along line IVB—IVB in FIG. 4A.

FIG. 13 is a schematic cross-sectional view of a further liquid phase discharge port assembly in accordance with the present invention, taken in a radial and longitudinal plane.

FIG. 14 is a cross-sectional view of a flow guide member of a liquid phase discharge port assembly in accordance with the present invention.

FIG. 15 is a schematic cross-sectional view of another additional liquid phase discharge port assembly in accordance with the present invention, taken in a radial and longitudinal plane.

DEFINITIONS

The word "passageway" as used herein denotes a lumen, bore, or channel of virtually any cross-section. Thus, a passageway may be circular, elliptical, polygonal, star-shaped, or irregular.

The term "tubular member" is used herein to generally define a generally elongate member that is circular, elliptical or oval in cross-section. The tubular member may have bends or turns that are circular, elliptical or oval in cross-section. The term "tubular passageway" is similarly used herein to describe a lumen or elongate opening that is circular, elliptical or oval in cross-section.

The terms "elbow" and "elbow pipe" and "elbow pipe section" are alternately used herein to denote a tubular member having at least one bend or turn through an angle in a range of about 45° to about 135° (optimally 70° to 110°). More particularly, an "elbow" or "elbow pipe" "elbow pipe section" has a tubular input branch or arm, an arcuate section and a tubular outlet branch or arm, where the input branch or arm and the outlet branch or arm are disposed at an angle in a range of about 45° to about 135° (optimally 70° to 110°) to one another.

An "elbow passageway" as that term is used herein refers to a lumen, elongate opening, bore, or channel that is tubular and has at least one bend or turn through an angle in a range of about 45° to about 135° (optimally 70° to 110°).

The term "liquid phase" is used herein to designate a light phase produced during centrifugation. A liquid phase may include solids or particulate matter suspended in a liquid carrier.

The term "liquid phase discharge path" refers herein to a trajectory of a liquid phase upon exiting an outlet port in a discharge port assembly. A discharge path thus extends from a liquid phase discharge outlet in a space outside of a rotating machine such as a centrifuge bowl.

DETAILED DESCRIPTION OF THE PREFERRED EMBODIMENTS

Figure 1:
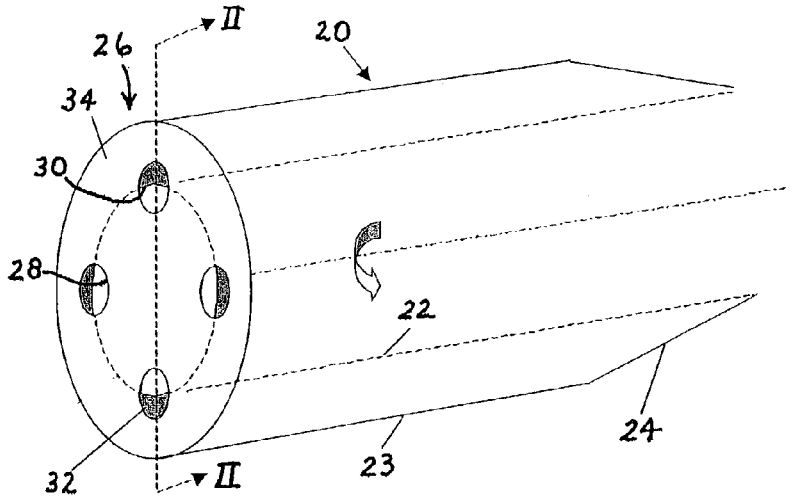
PRIOR ART FIG. 1
FIG. 1 is a highly schematic partial perspective view of a conventional decanter centrifuge bowl.
Figure 2:
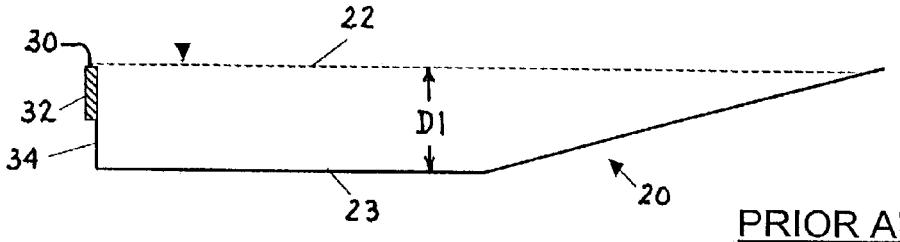
PRIOR ART FIG. 2
FIG. 2 is a similarly schematic longitudinal cross-sectional view taken along line II—II in FIG. 1.

FIGS. 1 and 2 are diagrams of a bowl 20 of a conventional decanter centrifuge. For simplicity, the conveyor, feed system and drives are not shown. A feed slurry is introduced into a separation pool 22 after the bowl has been accelerated to a predetermined angular velocity. In the pool 22, the heavier solids settle in a clarifier 23 to form a concentrated underflow or cake (not shown) that is transported up a conical beach 24 by a differential rotation between the conveyor and bowl 20, while the clarified liquid free from solids overflows at a large end 26 of the bowl 20 through a discrete set of ports 28. The pool depth D1 in the decanter bowl 20 is determined by the radial location of spill edges 30 of respective weir plates 32 attached to a bowl head 34 at the large end of the bowl.

Pool depth D1 may be set via weir plates 32. By using weir plates 32 of different sizes, the radius corresponding to the pool depth D1 of the pool can be adjusted for optimization for a given process application. For thickening of municipal sludge from 0.3–1% solids to 4–6% underflow with minimal solids in the effluent liquid, the pool depth D1 is set as deep as possible to reduce the radius of discharge and thus the hydraulic power consumed. The power consumed is proportional to the product of speed and discharge radius to the second power and the first power of the flow rate. Thus, a smaller liquid discharge radius reduces also the hydraulic power component, which is a major contributor to power consumption in some process applications especially those that require high volumetric feed rate.

Figure 3A:
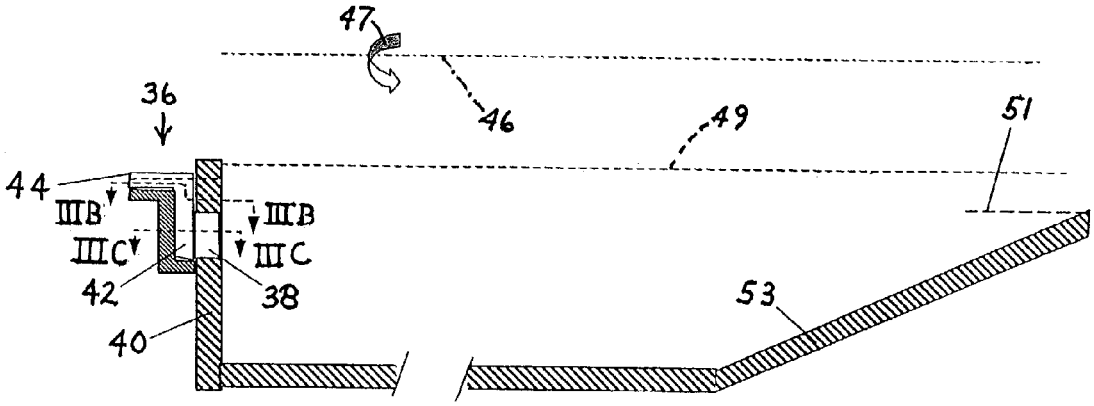
PRIOR ART FIG. 3A
FIG. 3A is a schematic longitudinal cross-sectional view of a decanter centrifuge bowl with a power recovery device of the prior art.

A turning-vane apparatus 36 as disclosed in U.S. Pat. No. 5,147,277 is shown in FIG. 3A. Clarified flow from a port 38 of a bowl head 40 is channeled into the turning vane apparatus 36, which comprises a plurality of channels formed by radial vane sections 42 and respective circumferential vane sections 44. Radial vane section are disposed between bowl head 40 and a wall 41 of the turning vane apparatus 36. The liquid phase flow is first directed radially inward toward a bowl rotation axis 46 and then circumferentially in a direction opposite to the direction of bowl rotation. As depicted in FIG. 3C, at the upstream end of turning-vane apparatus 36, the vanes are straight and radial directing the flow radially inward from an original axial flow orientation at the inlet of the apparatus. FIG. 3B shows that the flow reaching the smaller radius at the downstream end of the turning-vane apparatus 36 is redirected in an exit plane 45 in a direction opposite to the direction of rotation 47. The pressure drop required for the device where flow has to make two 90-degree turns is large and given that the discharge radius of the device is very close to the pool surface or level 49, the pool level upstream can be significant. Indeed FIG. 3A depicts that the pool level 49 could very well be higher compared with the spill point 51 of the conical beach 53. This causes an increasing fraction of underflow to discharge at the conical discharge or spill point 51, reducing the consistency of that stream. Also the apparatus might not be able to establish a high jet velocity to minimize power consumption because of the large pressure loss associated with this design.

As illustrated in FIG. 4A, a centrifuge bowl 56 including a cylindrical clarifier section 58 and a conical beach section 60 is provided on a head or end wall 62 with a liquid phase discharge port assembly 64 including a tubular member 66 in the form of an elbow. As illustrated in FIGS. 4A and 4B, elbow 66 includes an upstream branch or arm 68 attached to head 62 and communicating with a slurry pool 70 in bowl 56 through a port 125 in the bowl head 62. Elbow 66 includes a downstream branch or arm 72 defining a liquid phase discharge trajectory or path 74 extending in a direction substantially opposite to the rotation direction 76 of bowl 56. The liquid phase discharge jet exiting a downstream end 78 of elbow 66 exerts a reaction torque on bowl 56 that aids in rotation and reduces power consumption from the drive motor. Trajectory or path 74 may extend at an angle a1 to a surface 80 of bowl head 62 for purposes of decreasing the incidence of discharging liquid onto that surface. The more the discharging liquid impinges on bowl head surface 80, the greater the reacceleration of the liquid and the greater a concomitant drag on bowl rotation, which increases power consumption.

The level 79 of pool 70 (FIG. 4A) and concomitantly the difference 81 in radial position between pool level 79 and tubular port member or elbow 66 depends in part on the diameter or cross-sectional area of the elbow. Other factors (such as flow rate through the nozzle, shape and wall profile of nozzle, etc.) remaining constant, the difference 81 in radial position decreases with increasing diameter of elbow 66.

Figure 5A:
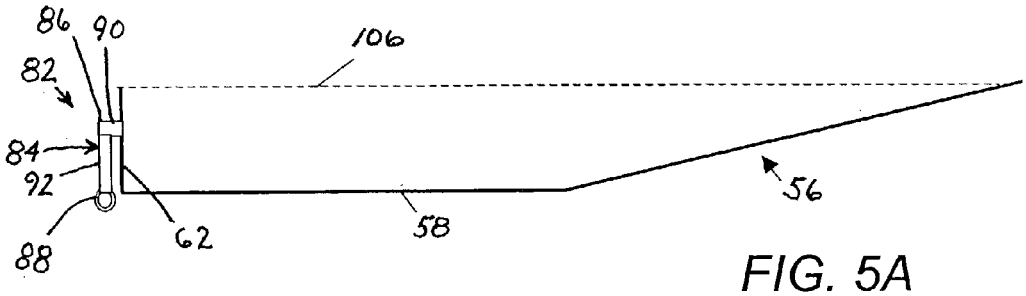
FIG. 5A is a schematic longitudinal cross-sectional view of a decanter centrifuge bowl with another liquid phase discharge port assembly in accordance with the present invention.
Figure 5B:
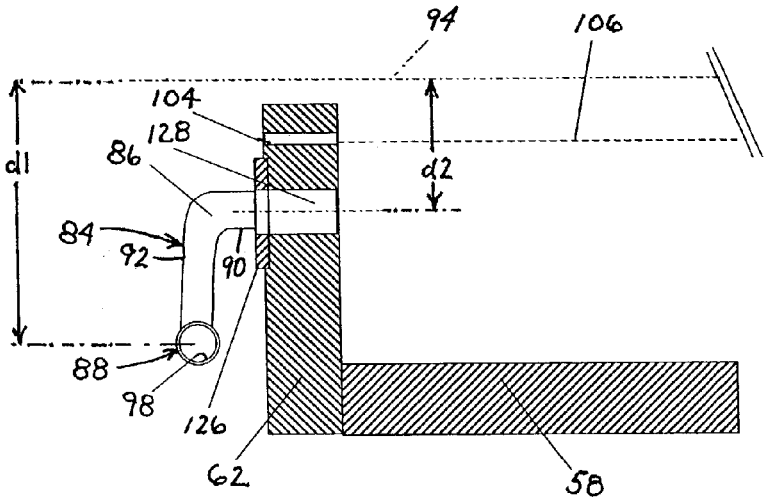
FIG. 5B is a schematic cross-sectional view similar to FIG. 5A, on a larger scale.
Figure 5C:
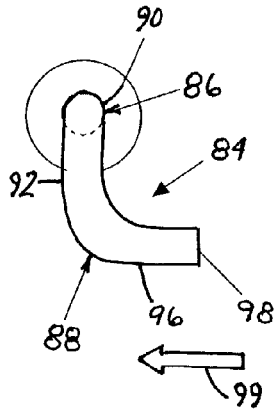
FIG. 5C is a schematic partial elevational view of the port assembly of FIGS. 5A and 5B taken from the left side in those figures.

As depicted in FIGS. 5A, 5B, and 5C, centrifuge bowl 56 may alternatively be provided, in an end wall (not separately designated) of bowl head 62, oriented transversely to rotation axis 94, with a liquid phase discharge port assembly 82 including a tubular member 84 comprising an upstream elbow pipe section 86 and a downstream elbow pipe section 88 connected in seriatim. Elbow pipe section 86 has an upstream branch or arm 90 mounted to head 62 and a downstream branch or arm 92 merging into or integral with an upstream branch or arm (not separately designated) of elbow pipe section 88. Upstream branch or arm 90 of the first elbow pipe section 86 extends generally parallel to a rotation axis 94 of bowl 56, while branch or arm 92 extends radially relative to the rotation axis. A downstream branch or arm 96 of second elbow pipe section 88 is oriented substantially perpendicularly to a plane defined by the branches or arms 90 and 92 of the first elbow pipe section 86. Downstream branch or arm 96 has an outlet opening 98 located at a distance d1 from axis 94 greater than a distance d2 from the axis of a port or opening in bowl head 62 at which tubular member 84 is attached.

Downstream branch or arm 96 defines a liquid phase discharge trajectory or path (not indicated) extending in a direction substantially opposite to the rotation direction 99 of bowl 56. The liquid phase discharge jet exiting opening or downstream end 98 of elbow 88 exerts a reaction torque on bowl 56 that aids in rotation and reduces power consumption of the centrifuge drive.

As depicted in FIG. 5B, bowl head 62 may be formed with an opening 104 disposed closer than port 128 to rotation axis 94 for defining a pool level or surface 106.

Figure 6:
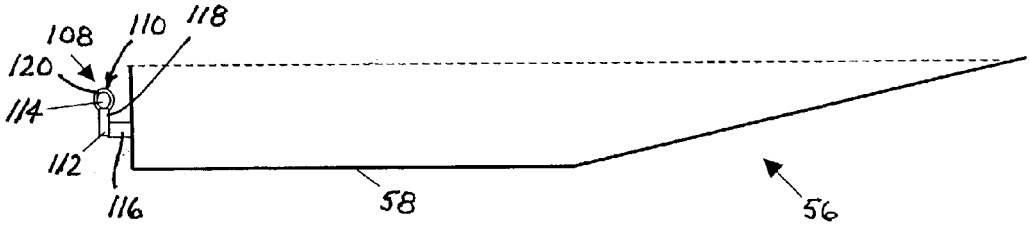
FIG. 6 is a schematic longitudinal cross-sectional view of a decanter centrifuge bowl with yet another liquid phase discharge port assembly in accordance with the present invention.

As shown in FIG. 6, a liquid phase discharge port assembly 108 may include a tubular member 110 comprising an upstream elbow pipe section 112 and a downstream elbow pipe section 114 connected in seriatim. Elbow pipe section 112 has an upstream branch or arm 116 mounted to head 62 and a downstream branch or arm 118 merging into or integral with an upstream branch or arm (not separately designated) of elbow pipe section 114. Upstream branch or arm 116 of the first elbow pipe section 112 extends generally parallel to the rotation axis of bowl 56, while branch or arm 118 extends radially inwardly. A downstream branch or arm 120 of second elbow pipe section 114 is oriented substantially perpendicularly to a plane defined by the branches or arms 116 and 118 of the first elbow pipe section 112 and arm 120 has an outlet (not designated) to discharge a jet with a component in a direction opposite to rotation of the bowl. Downstream branch or arm 120 has an outlet opening located at a distance from the machine rotation axis less than the distance from the axis of the inlet opening of branch or arm 116 of upstream elbow pipe section 112.

It is to be understood that liquid discharge port assemblies 64, 82, and 108 are preferably provided in multiple units angularly equispaced about bowl head 62. Port assemblies 64, 82, and 108 may be attached in any acceptable manner to bowl head 62. For instance, where flanges 124 (FIG. 4B) and 126 (FIGS. 5B and 5C) are included in discharge port assemblies 64 and 82, tubular members 66 and 84 may be bolted to bowl head 62.

Tubular members 66, 84 and 110 and particularly the elbows thereof are preferably made of a hard wear resistant material. Their upstream branches or arms 68, 90, and 116 are attached to bowl head 62 over an opening or port 125, 128 (FIGS. 4B and 5B) therein and communicate via that port with the slurry pool in bowl 56.

Figure 7:
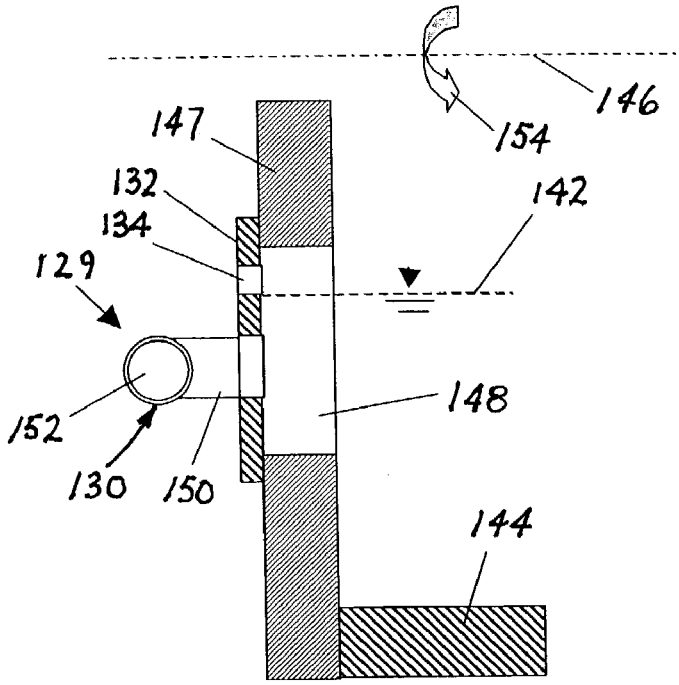
FIG. 7 is a schematic cross-sectional view of another liquid phase discharge port assembly in accordance with the present invention, taken in a radial and longitudinal plane.

FIG. 7 depicts a liquid phase discharge assembly 129 comprising an elbow element 130 rigid with a weir plate 132 provided with an overflow port 134. Overflow port 134 determines a level 142, or location of an inner cylindrical surface, of a slurry pool (not separately designated) in a centrifuge bowl 144 that rotates about a machine axis 146. Weir plate 132 is fastened to a head or end wall 147 of bowl 144, over an opening 148 therein, via bolts (not shown) or other suitable means. Elbow element 130 has an inlet branch or arm 150 extending parallel to axis 146 and an outlet branch or arm 152 extending in a circumferential direction opposite to a direction of rotation 154 of the bowl.

Figure 8:
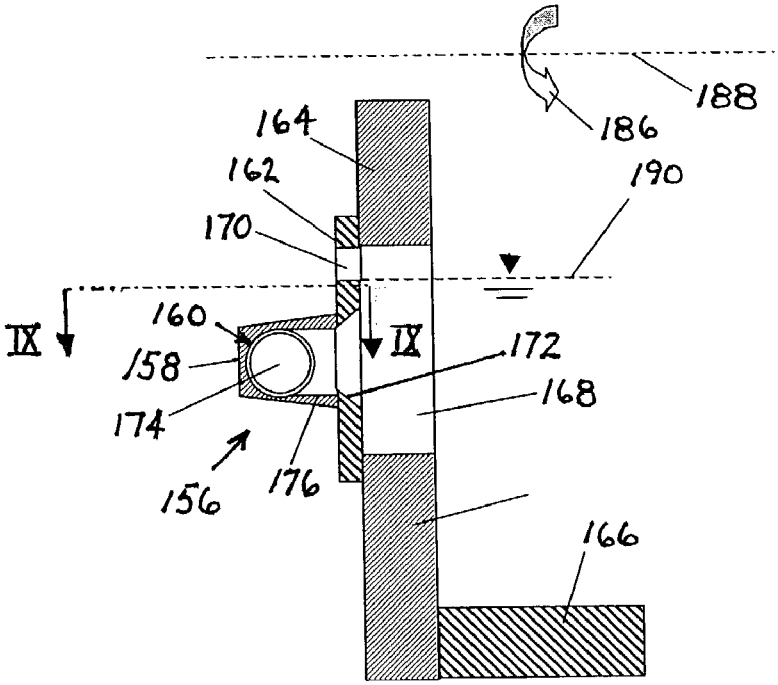
FIG. 8 is a schematic cross-sectional view of an additional liquid phase discharge port assembly in accordance with the present invention, taken in a radial and longitudinal plane.
Figure 9:
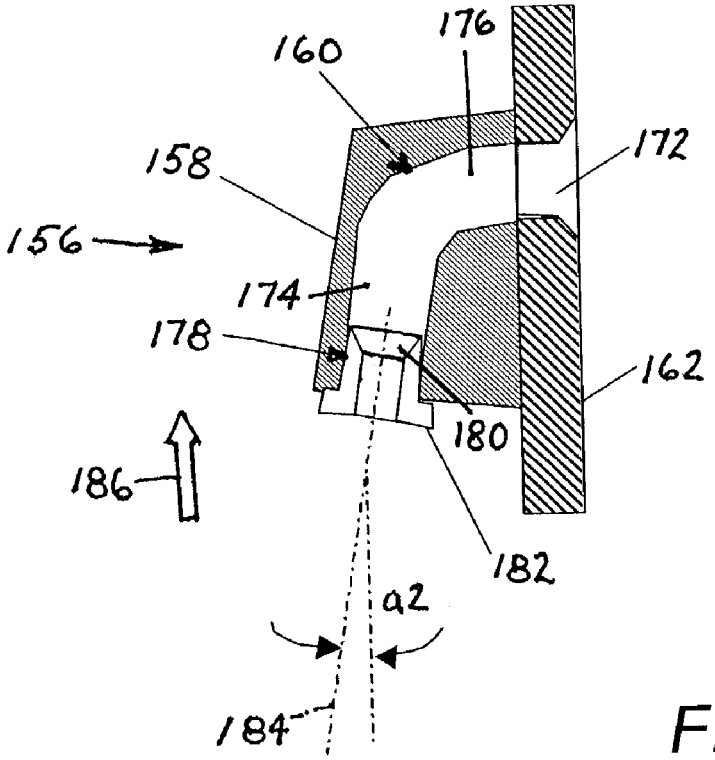
FIG. 9 is a cross-sectional view taken along line IX—IX in FIG. 8.

FIGS. 8 and 9 depict a discharge port assembly 156 essentially identical to the discharge port assembly 129 of FIG. 7. FIG. 9 is a view taken along line IX—IX of FIG. 8. Instead of an elbow pipe, port assembly 156 includes a block 158 machined to incorporate a tubular passageway 160 having an elbow configuration. Block 159 is rigidly fixed to a weir plate 162 in turn removably fastened (e.g., via bolts, not shown) to a head or end wall 164 of a centrifuge bowl 166. Weir plate 162 is positioned over an opening 168 in bowl head 164 so that an overflow port 170 and a tapered or beveled inlet 172 formed in the weir plate communicate with a slurry pool (not designated) in bowl 166 via opening 168. On a downstream side, tapered or beveled inlet 172 is aligned with an upstream branch 176 of passageway 160. A downstream branch 174 of passageway 160 is provided at an outlet (not separately designated) with a nozzle member 178 having a tapered or chamfered inlet surface 180. Nozzle member 178 has a flange or shoulder 182 that abuts against an outer surface (not designated) of block 158. Nozzle member 178 may be mounted inside downstream branch 174 of passageway 160 via mating screw threads (not shown). Downstream passageway branch 174 and nozzle member 178 direct a jet of liquid phase along a discharge path or trajectory 184 that is substantially circumferentially oriented and substantially opposite to the direction of bowl rotation 186 about a machine axis 188. More specifically, discharge path or trajectory 184 subtends an angle a2 of between about 10° and 30° and preferably about 15° with respect to bowl head 164. Overflow port 170 defines a pool level 190.

Figure 10:
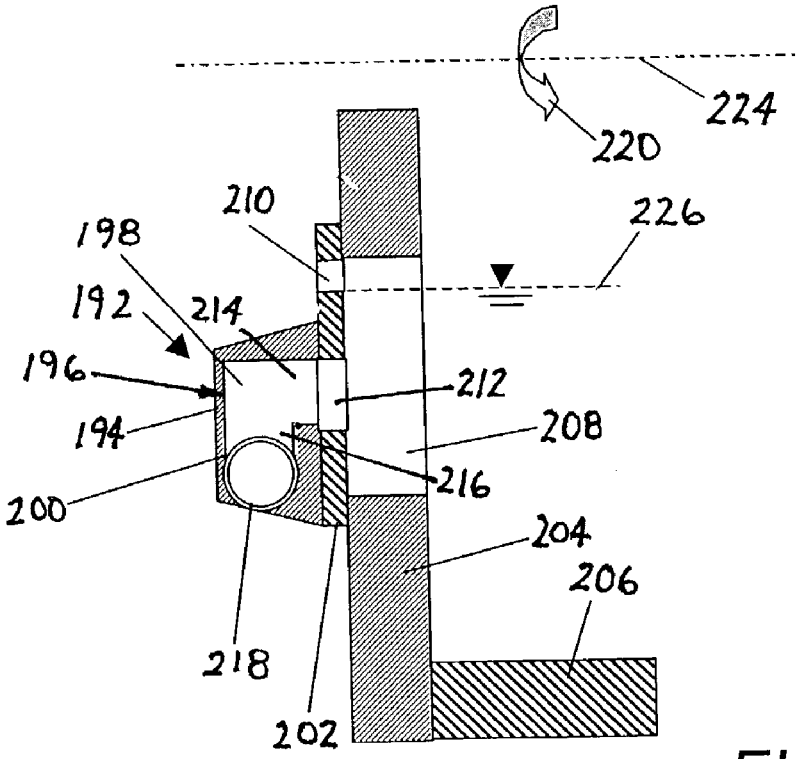
FIG. 10 is a schematic cross-sectional view of yet another liquid phase discharge port assembly in accordance with the present invention, taken in a radial and longitudinal plane.

FIG. 10 depicts a discharge port assembly 192 including a block 194 machined to incorporate a tubular passageway 196 having an upstream elbow portion 198 and a downstream elbow portion 200. Block 194 is rigidly fixed to a weir plate 202 in turn removably fastened to a head or end wall 204 of a centrifuge bowl 206. Weir plate 202 is positioned over an opening 208 in bowl head 204 so that an overflow port 210 and an inlet 212 formed in the weir plate communicate with a slurry pool (not designated) in bowl 206 via opening 208. Inlet 212 opens into an upstream branch 214 of elbow portion 198. A downstream branch 216 of elbow portion 198 is coincident with an upstream branch (not separately labeled) of elbow portion 200. A downstream branch 218 of elbow portion 200 is provided at an outlet (not separately designated) with a nozzle member (not shown) as discussed above with reference to FIGS. 8 and 9. Downstream branch 218 of downstream elbow portion 200 (together with the associated nozzle member) directs a jet of liquid phase along a discharge path or trajectory that is substantially circumferentially oriented and substantially opposite to the direction of bowl rotation 220 about a machine axis 224. Overflow port 210 defines a pool level 226.

Figure 11:
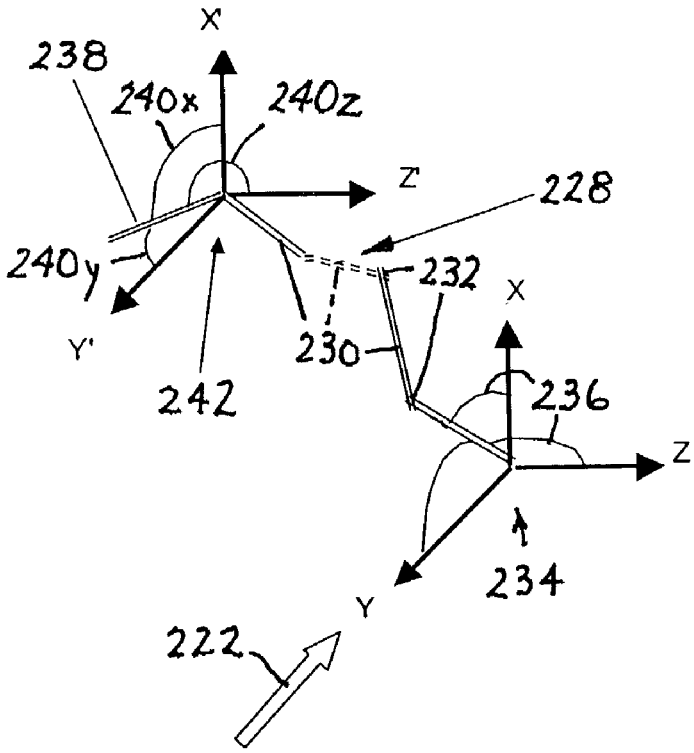
FIG. 11 is a diagram of a discharge port assembly in general in accordance with the present invention.

FIG. 11 diagrams a generic passageway 228 of a discharge port assembly (not shown). The passageway 228 has multiple branches or segments 230 interconnected via bends or turns 232. Where the branches 230 are linear, each branch may be completely defined by the locations of an upstream or inlet end (not designated) and a downstream or outlet end (not designated) relative to a Cartesian coordinate system 234. Alternatively, branch orientation may be defined by a set of angles 236 with respect to the x, y, and z coordinate axes of system 234. A final or outlet branch of segment 238 of passageway 228 is oriented at such angles 240*x*, 240*y*, 240*z* with respect to axes x', y', z' of a respective parallel Cartesian system 242 that a liquid jet ejected from the outlet branch 238 travels along a discharge path or trajectory that is substantially circumferential and substantially opposed to the direction 222 of machine rotation. That path or trajectory has an angle 240*y* typically less than 15°.

Figure 12:
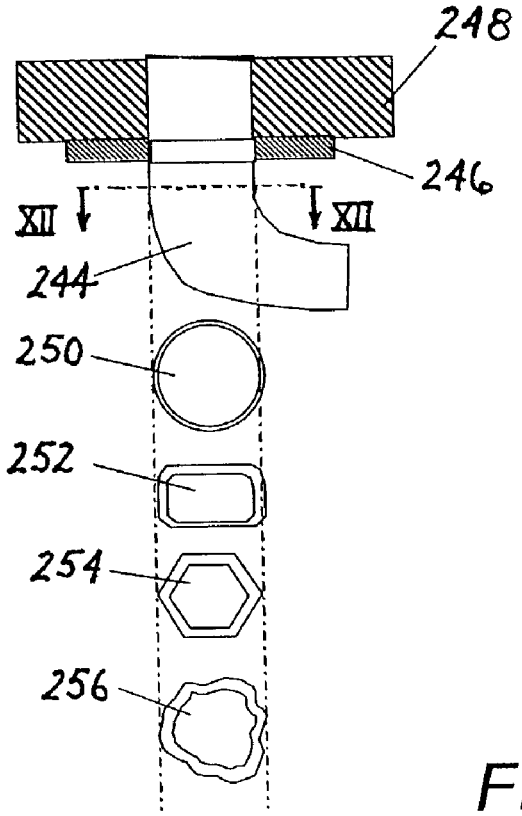
FIG. 12 is a combination cross-sectional view similar to FIG. 4B and a series of cross-sectional views taken along line XII—XII showing different alternative cross-sections of a liquid discharge passageway in accordance with the present invention.

FIG. 12 illustrates an elbow guide member 244 of a port assembly including a flange or weir plate 246 mounted to a bowl head 248. Guide member 244 may have a circular cross-section 250, a rectangular cross-section 252, a polygonal cross-section 254, an irregular cross-section 256, etc.

Various embodiments of a discharge port assembly discussed hereinabove contemplate a single passageway extending from any given port or opening in a bowl wall. As depicted in FIG. 13, a flow guide member 258 of a liquid phase discharge port assembly 260 connected to a bowl head 262 via a flange or weir plate 264 may be provided internally with a plurality of parallel partitions or vanes 265 defining a plurality of passageways 266. Passageways 266 each undergo a first elbow-type turn 268 from a direction parallel to a machine rotation axis 270 to a substantially radial direction (within 15° of radial) outward from the axis and a second elbow-type turn 271 to a substantially circumferential direction substantially opposed to the machine rotation direction 272. This circumferential direction is the orientation of a liquid phase discharge path or trajectory and is substantially perpendicular to a plane defined by the first two directions of the passageways 266. Passageways 266 have a discharge radius 274 (distance from axis 270) that is greater than the inlet radius 276 of flow guide member 258.

FIG. 14 illustrates in cross-section a flow guide member 278 which may be incorporated into a liquid phase discharge port assembly as disclosed herein. Guide member 278 includes a housing 280 enclosing a plurality of parallel flow channels 284. Flow guide member 278 may be used, for example, in discharge port assembly 260 of FIG. 13 or in a discharge port assembly 286 of FIG. 15.

As shown in FIG. 15, discharge port assembly 286 comprises an elbow-shaped guide member 288 provided internally with multiple partitions or vanes 290 defining a plurality of flow channels or passageways 292 each negotiating a single turn from a direction parallel to a machine rotation axis 294 to a substantially circumferential direction opposed to a machine rotation direction 296. Channels 292 have exit openings (not separately designated) with an outlet radius 298 equal to an inlet radius 300 of guide member 288. Guide member 288 is attached to a bowl head 302 via a flange or weir plate 304.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A rotating machine comprising:

a bowl rotatable about an axis to generate a cylindrical pool of a feed slurry, said bowl having a heavy phase discharge port; and at least one liquid phase discharge port assembly provided on said bowl to define a liquid phase discharge path extending from an outlet of said discharge port assembly and having a circumferential component oriented in opposition to a direction of rotation of said bowl, said discharge port assembly having a tubular passageway including a first bend or turn from a first direction with a component parallel to an axis of rotation of said bowl to a second direction with a component perpendicular to said axis, said tubular passageway further including a second bend or turn from said second direction to a third direction with a component substantially perpendicular to said first direction and said second direction.

2. The rotating machine defined in claim 1 wherein said tubular passageway defines exactly two bends or turns.

3. The rotating machine defined in claim 1 wherein said third direction is oriented substantially opposite to a direction of bowl rotation.

4. The rotating machine defined in claim 1 wherein said tubular passageway has an inlet end disposed at a first radial distance from said axis and an outlet end disposed at a second radial distance from said axis, said second radial distance being at least as great as said first radial distance.

5. The rotating machine defined in claim 1 wherein said tubular passageway comprises at least a first elbow element and a second elbow element connected in seriatim to one another, said first elbow element being connected at an inlet end to said bowl to communicate with said pool.

6. The rotating machine defined in claim 5 wherein said liquid phase discharge port assembly includes a nozzle at an output end of said second elbow element.

7. The rotating machine defined in claim 6 wherein said nozzle has a tapering internal profile to reduce head loss in accelerating liquid to discharge at high velocity.

8. The rotating machine defined in claim 1 wherein said outlet is provided with a nozzle to discharge a jet at high velocity.

9. A rotating machine comprising:

a bowl rotatable about an axis to generate a cylindrical pool of a feed slurry, said bowl having a heavy phase discharge port; and at least one liquid phase discharge port assembly provided on said bowl to define a liquid phase discharge path extending from an outlet of said discharge port assembly and having a circumferential component oriented in opposition to a direction of rotation of said bowl, said discharge port assembly having a tubular passageway with a first bend or turn from a first direction with a component parallel to an axis of rotation of said bowl to a second direction with a component in the radial direction, said tubular passageway having a second bend or turn from said second direction to a third direction with a component substantially in a circumferential direction.

10. The rotating machine defined in claim 9 wherein said passageway has exactly two bends or turns.

11. The rotating machine defined in claim 9 wherein said tubular passageway has an inlet end disposed at a first radial distance from said axis and an outlet end disposed at a second radial distance from said axis, said second radial distance being at least as great as said first radial distance.

12. The rotating machine defined in claim 9 wherein said passageway is defined by at least one elbow element.

13. The rotating machine defined in claim 12 wherein said passageway is defined by two elbow elements connected in seriatim to one another.

14. The rotating machine defined in claim 9 wherein said liquid phase discharge port assembly includes a nozzle disposed at an output end of said passageway to eject a jet of liquid phase at high velocity.

15. The rotating machine defined in claim 14 wherein said nozzle has a tapering internal profile to reduce head loss in accelerating liquid phase to discharge at high velocity.

* * * * *